US005979662A

United States Patent [19]

Green

[11] Patent Number: 5,979,662

[45] Date of Patent: Nov. 9, 1999

[54] PACKAGING ASSEMBLY, AND RELATED METHOD, FOR SHIPPING AND DISPLAYING A PLURALITY OF PRODUCTS

[75] Inventor: Jeffrie Green, Beverly Hills, Calif.

[73] Assignee: U.S. Optical Merchants, Inc., Los Angeles, Calif.

[21] Appl. No.: 08/941,490

[22] Filed: Sep. 30, 1997

[51] Int. Cl.[6] ..... B65D 1/34; B65D 85/00

[52] U.S. Cl. ..... 206/764; 206/463; 206/467; 206/485; 206/526; 206/756; 206/813

[58] Field of Search ..... 206/461–463, 206/467, 471, 485, 526, 756, 763–765, 774, 564, 565, 813; 53/171, 449

[56] References Cited

U.S. PATENT DOCUMENTS

| | | | |
|---|---|---|---|
| D. 353,092 | 12/1994 | Green . | |
| 1,727,092 | 9/1929 | Bang | 206/813 X |
| 2,078,018 | 4/1937 | Powell | 206/756 |
| 3,009,622 | 11/1961 | Leone | 206/485 X |
| 3,313,407 | 4/1967 | Palm, Jr. | 206/526 |
| 3,314,530 | 4/1967 | Michalles | 206/756 |
| 3,343,659 | 9/1967 | Marondel | 206/774 X |
| 3,856,137 | 12/1974 | Brindley | 206/564 |
| 3,927,261 | 12/1975 | Boyle | 206/485 X |
| 4,025,039 | 5/1977 | Croll et al. | 206/485 X |
| 4,485,922 | 12/1984 | Desmond et al. | 206/485 |
| 4,582,194 | 4/1986 | Karpiloff et al. | 206/485 |
| 4,749,082 | 6/1988 | Gardener et al. | 206/471 X |
| 4,848,577 | 7/1989 | Hoffman et al. | 206/471 X |
| 5,097,953 | 3/1992 | Gingras | 206/467 X |
| 5,363,964 | 11/1994 | Hexter, Jr. | 206/449 |
| 5,573,117 | 11/1996 | Adams | 206/467 X |

FOREIGN PATENT DOCUMENTS

| | | | |
|---|---|---|---|
| 877412 | 9/1942 | France | 206/485 |

*Primary Examiner*—Bryon P. Gehman

*Attorney, Agent, or Firm*—Sheppard, Mullin, Richter & Hampton; John A. Griecci

[57] ABSTRACT

A packaging assembly, and method of packaging a plurality of products, for economically and safely shipping and displaying a plurality of products. The packaging assembly includes a display stand, a plurality of display packs holding the plurality of products, and a shipping cover. The display stand is constructed from a single sheet of cardboard, and includes a rectangular base panel, a front panel having a gap for viewing, and two parallel side panels. Each side panel includes a plurality of slots that correspond with slots in the other side panel. Each display pack is an approximately planar assembly formed from front and rear portions of transparent, vacuum-molded plastic. The front and rear portions are each configured with a flange, the flanges each forming conforming notches allowing the two portions to be adjoined and heat sealed or glued together. The display pack includes a product chamber configured to hold the product, and further contains a product display card. The corresponding pairs of slots are configured to receive the display pack flanges to support and display the products in the product chamber. The display packs are inserted into succeeding corresponding pairs of the slots. The front and rear portions include frames configured to adjoin with the frames of adjacent display packs to provide structural support to each succeeding display pack. The display stand with the plurality of inserted display packs may be covered with a shipping cover to provide a structurally sound rectangular box suitable for shipping. The shipping cover is a conventional, five-sided, open-topped, rectangular box, having an opening that conforms to the shape and size of the base panel, allowing the shipping cover to be taped, along its opening, to the under side of the display stand's base panel.

In an alternate embodiment, the display stand includes an insert allowing two rows of display packs within the packaging assembly.

39 Claims, 6 Drawing Sheets

10
16
14
18
14
4
4
12

PACKAGING ASSEMBLY, AND RELATED METHOD, FOR SHIPPING AND DISPLAYING A PLURALITY OF PRODUCTS

BACKGROUND OF THE INVENTION

This invention relates generally to bulk packaging configured for both shipping and display and, more particularly, to a packaging assembly, and a related method, for economically and safely shipping and displaying a plurality of products.

Traditionally, products have been shipped in bulk from a manufacturer to a retailer in cartons containing protective packing material. Individual products were then removed from the cartons to be individually placed on a shelf or rack for display. For small, expensive and easily stolen products, the shelf or rack might be located within a secured display case to minimize the risk of theft.

This system of shipping and display is both costly and time consuming. The manufacturer must often pay relatively expensive initial packaging costs, particularly for items that are easily damaged by rough handling. The retailer must pay employees to individually place each product item on display in a manner that is both appealing to the customer and safe for the product. Furthermore, for small, expensive and easily stolen products, which are kept in secured display cases, the retailer must pay a sales person to attend to each customer wishing to inspect the products. These costs are typically passed along to the product's purchaser, who receives little benefit from them other than to receive a product that has safely survived the rigors of shipping. Thus, there is a continuing need for more economical means of safely and efficiently shipping and displaying products for sale.

It is known that small products may be packaged in comparatively large containers to deter theft. However, these containers require the use of large amounts of retail space, and the containers must be decorated and otherwise configured to appeal to consumers, adding to the total product packaging cost. Thus, some manufacturers have used smaller packaging, with an optional, transparent display pack, such as a blister pack, available at a retailer's request.

The display pack, which contains the product within its smaller packaging, typically is significantly larger than the small packaging, providing for increased deterrence of theft. Preferably, the display pack is configured with an appealing appearance to the customer, and it provides added safety in shipping. Commonly, the display pack is made from two vacuum-formed sheets of clear plastic, sealed around the edges, forming a chamber for holding the product. Such a display pack is relatively inexpensive, and it benefits from the appealing appearance of the small packaging, which is visible through the display pack. U.S. Design Pat. No. D 353,092, to Green, entitled "Blister Pack" discloses a transparent display pack assembly having several cavities for containing products.

It is also known to display products in their bulk shipping cartons. Commonly, a carton is either cut open, or torn open along a perforation, to reveal the products within the carton. If the shape of the product packaging is appropriate, such as for individual products in rectangular boxes, the products' containers may be neatly organized in rows within the carton. Such configurations, while reducing the effort necessary to stock shelves, may fail to offer significant shipping protections to delicate items. Furthermore, the displays sometimes suffer from a ragged appearance, potentially having visible cuts, tears and markings, both from shipping and from opening the carton.

Accordingly, there has existed a definite need for a packaging assembly for both economical and safe shipping and display of a plurality of products, and for a related method of shipping and displaying a plurality of products. The present invention satisfies these and other needs, and provides further related advantages.

SUMMARY OF THE INVENTION

The present invention provides a packaging assembly for shipping and displaying a plurality of products. It provides for economy and safety by protecting the products from shipping damage, providing for fast and efficient display, and offering significant protection against theft without requiring the attention of a salesperson.

Embodiments of the invention include a plurality of display packs and a display stand. Each display pack is configured to hold one or more of the products, and is substantially larger than the product to deter theft. The display stand includes a base panel, having left and right edges, and left and right side panels. The left and right side panels have upper and lower ends, the left and right side panels' lower ends adjoining the base panel's left and right edges, respectively. Each side panel defines a plurality of slots, each slot in the left side panel having a corresponding slot in the right side panel, forming a corresponding pair of slots. The corresponding pairs of slots are configured to receive the plurality of display packs, and the plurality of display packs are configured to be inserted in the corresponding pairs of slots to form an assembled display assembly.

A feature of the invention is that embodiments include a shipping cover for covering the assembled display assembly. The shipping cover defines a cavity with an opening, the opening conforming to the periphery of the base panel. The cavity is configured to receive the assembled display assembly within the cavity such that the opening adjoins the periphery of the base panel.

In practice, the display packs are formed holding one or more of the plurality of products. The display packs are then inserted in the corresponding pairs of slots to form the assembled display assembly. The assembled display assembly is preferably then covered with the shipping cover, and taped to the shipping cover.

An advantage of this feature is that the shipping cover, taped to the base panel, preferably may form a six-sided rectangular box suitable for shipping. Furthermore, within the six-sided rectangular box, the display packs may adjoin the base panel and an inner face of the shipping cover to safely suspend the products during shipping.

The invention also features constructing the display stand from a unitary sheet, where each side panel comprises an inner layer facing the other side panel, and an outer layer facing away from the other side panel. The inner layer is spaced from the outer layer, and defines the plurality of slots. The front panel is preferably substantially rectangular, defining a gap for better viewing of the display packs. The display stand may further include inserts, where side panel slots correspond to insert slots. These features advantageously provides for economical construction of a base stand that is aesthetically, pleasing, and that provides for good viewing of the display packs.

Other features of the invention include that embodiments of the display packs comprise an approximately planar assembly formed from an approximately planar front portion adjoined to an approximately planar rear portion, each of which allows the products to be visible within the display pack. A product display card is located between the front and rear portions of the display pack, without obstructing the product. The front and rear portions are each configured with a flange extending around the periphery of the portion, with the flange configured to be received in any corresponding pair of slots. The front and rear portions are also configured with a frame protruding from the plane of the portions, in opposite directions when the front and rear portions are adjoined to hold the product. The frames of succeeding display packs in an assembled display assembly are configured to adjoin. These features advantageously provide for inexpensively manufactured display packs that protect the products during shipping, and also provide for aesthetically appealing displays that encourage strong product sales.

Other features and advantages of the invention will become apparent from the following detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
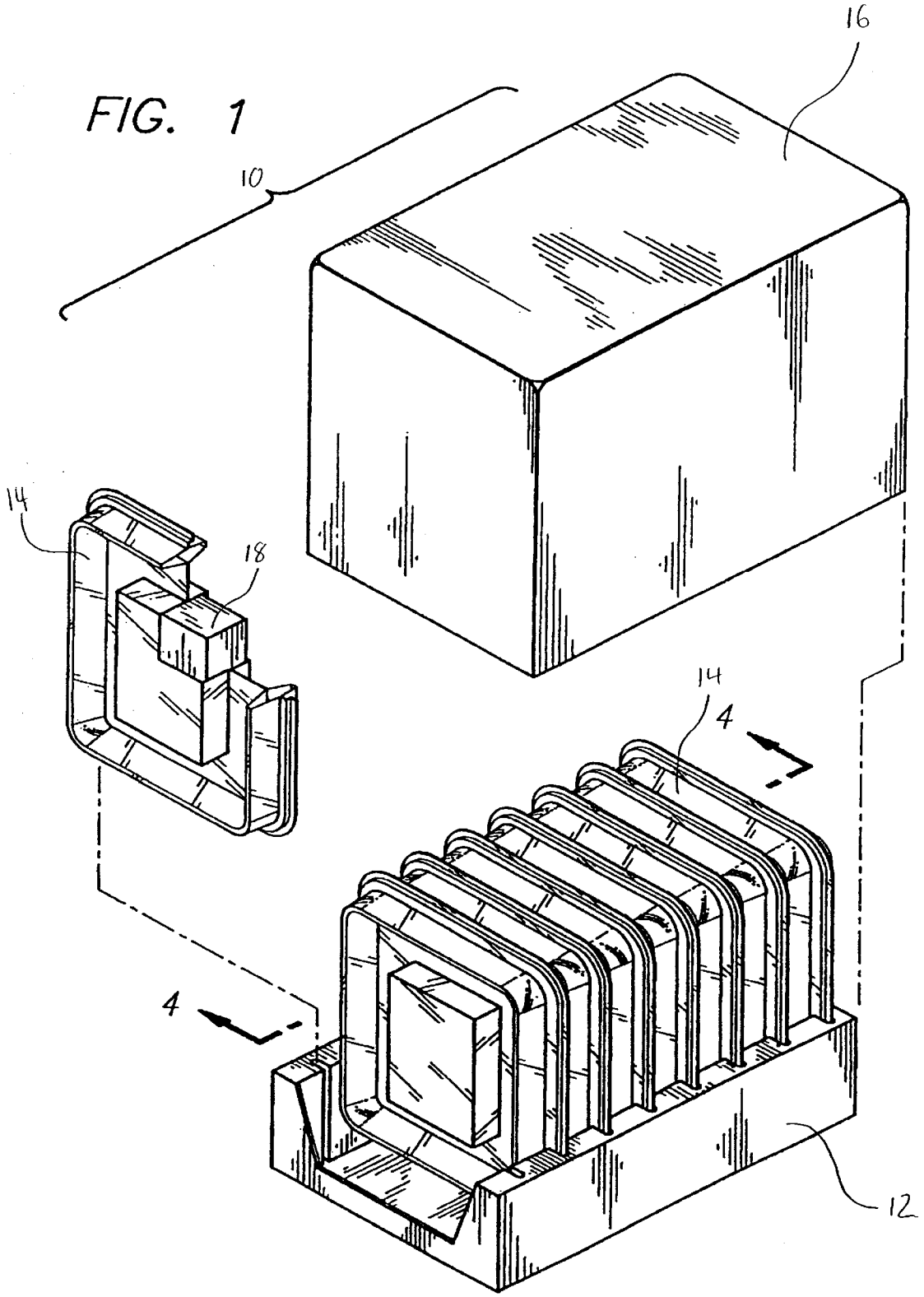
FIG. 1 is an exploded perspective and partially cut-away view of a packaging assembly embodying features of the present invention.

A packaging assembly 10 according to the present invention is shown in FIG. 1. The system includes a display stand 12, a plurality of display packs 14, and a shipping cover 16. Each display pack is configured to contain one or more packaged products 18 for both shipping and display.

Figure 2A:
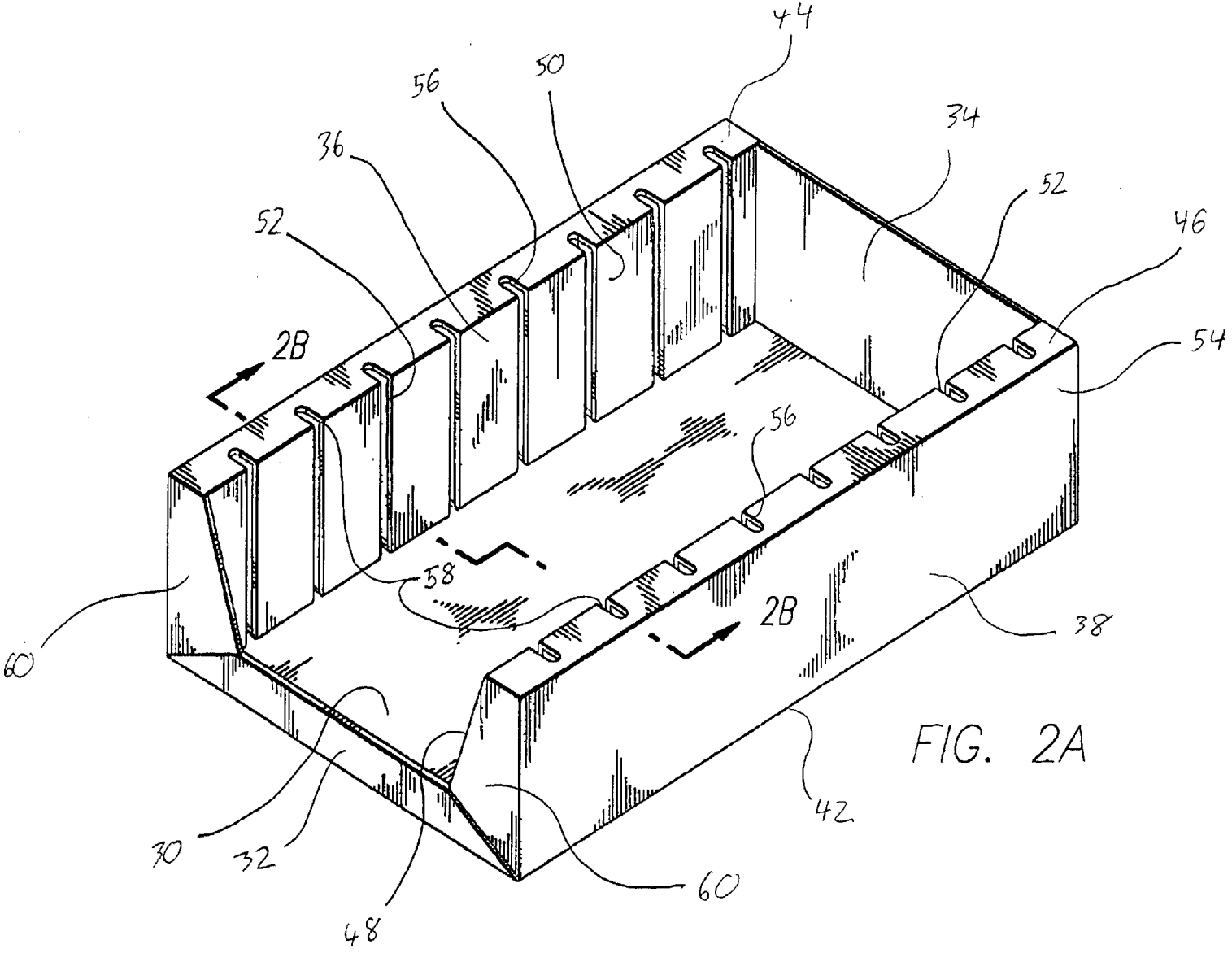
FIG. 2A is a perspective view of a display stand included in the packaging assembly depicted in FIG. 1.
Figure 2B:
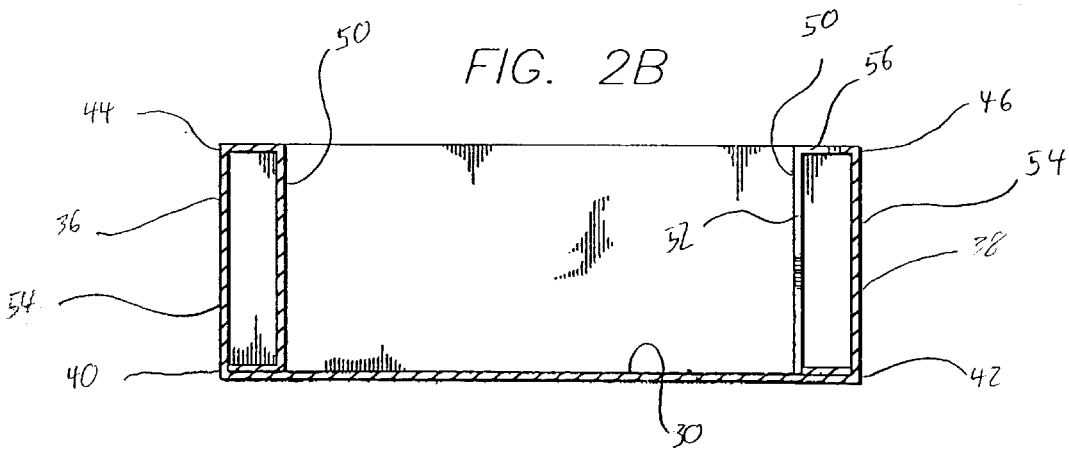
FIG. 2B is a cross-sectional, front elevational view of the display stand depicted in FIG. 2A, taken along line 2B—2B of FIG. 2A.

As seen in FIGS. 2A and 2B, the display stand 12 includes a rectangular base panel 30 having a front edge, a rear edge opposite the front edge, a left side edge, and a right side edge. The side edges parallel each other, extending between the front and rear edges on opposing sides of the base panel. A front panel 32, a rear panel 34, a left side panel 36, and a right side panel 38 are affixed to the front edge, rear edge, left side edge and right side edge, respectively. The front, rear, left side, and right side panels interconnect to form four walls around the base panel. The side panels lie in parallel planes, and are normal to the plane of the base panel.

The left side panel 36 and the right side panel 38 are rectangular, having lower ends 40, 42, respectively, and upper ends 44, 46, respectively. The lower end of the left side panel adjoins the left side edge of the base panel 30. Likewise, the lower end of the right side panel adjoins the right side edge of the base panel. The rear panel 34 is rectangular, extending between the left and right side panels at their rear ends. Similarly, the front panel 32 is rectangular, extending between the left and right side panels at their front ends. However, the front panel defines a substantial gap 48 for viewing the display packs.

Each side panel 36, 38 includes a plurality of sections that form layers of the side panel. An inner layer 50 of each side panel, facing the other side panel, includes a plurality of slots 52 that each start at the upper end 44, 46 of the side panel and extend toward the lower end 40, 42 of the side panel. An outer layer 54 of the panel, facing away from the other side panel, preferably does not include slots. The upper end of the panel forms slot ends 56 that define a useable depth for the inner-layer slots.

Each slot 52 in the left side panel 36 has a corresponding slot in the right side panel 38, and vice versa, forming corresponding pairs of slots. Corresponding pairs of slots 58 ran parallel to each other, and preferably are symmetrically located in the display stand 12. The pairs of corresponding slots are located at equal intervals along the display stand.

Figure 2C:
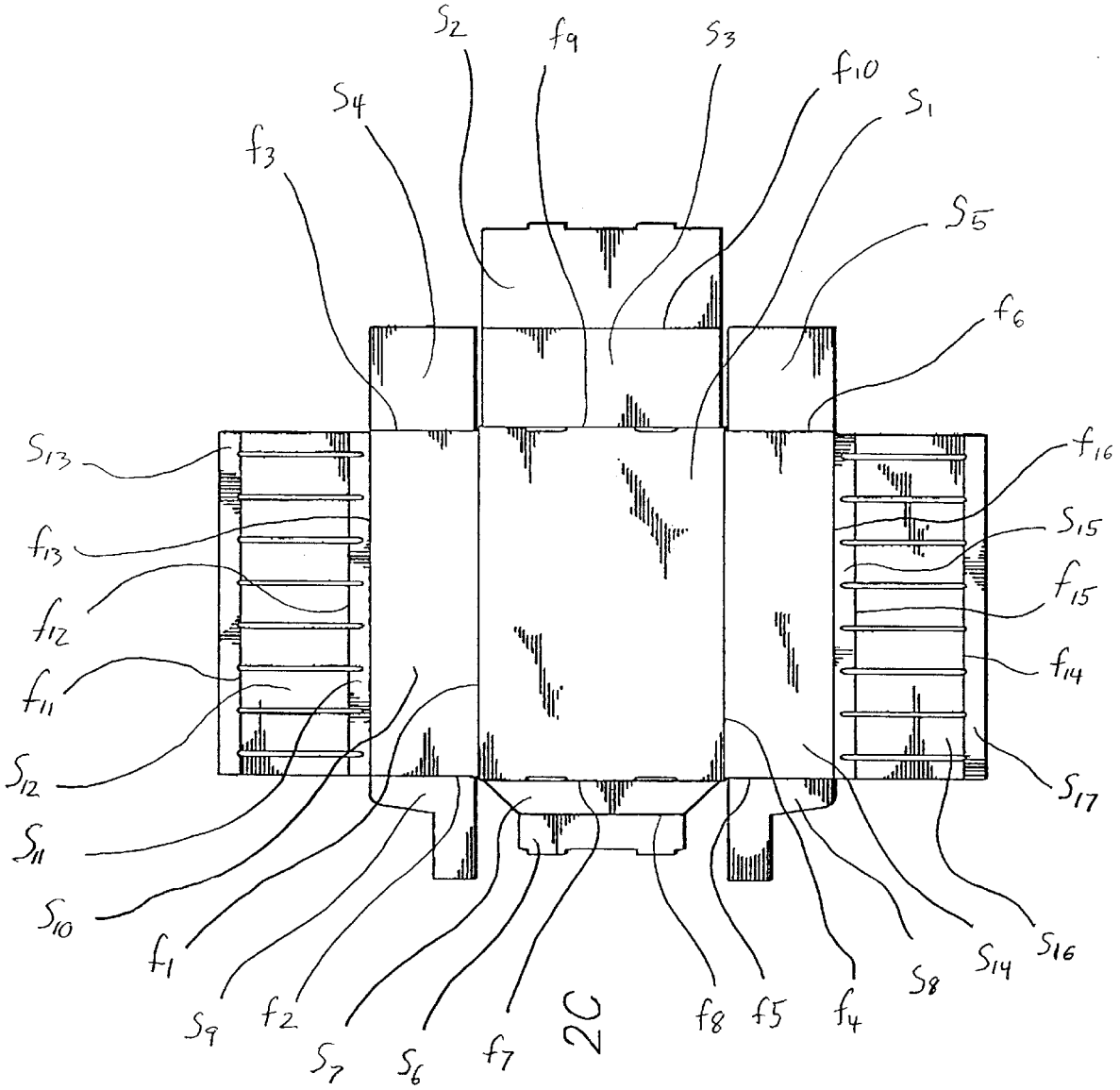
FIG. 2C is a top plan view of the display stand depicted in FIG. 2A, unfolded to reveal its component sections.

As seen in FIGS. 2A–2C, the display stand 12 is preferably constructed from a single, unitary sheet of cardboard or the like. The cardboard includes sixteen fold lines, designated f1–f16 in the figure, that divide the cardboard into seventeen sections, designated s1–s17 in the figure. The fold lines may be folded in numerical order (i.e., folding fold line f1 first, fold line f2 next, etc.) to construct the display stand. All fold lines are folded 90°, except fold lines f8 and f10 which are folded 180°. All fold lines are depicted from their interior side, i.e., the sides that will fold to angles less than 180°.

The base panel 30 is formed from section s1. The rear panel 34 includes an inner layer formed from section s2, an outer layer formed from section s3, and a two-part intermediate layer formed from sections s4 and s5. Similarly, the front panel 32 includes an inner layer formed from section s6, an outer layer formed from section s7, and a two-part intermediate layer formed from sections s8 and s9. The front panel intermediate layer includes two upstanding portions 60, which extend beyond the inner and outer layers to define the front panel's gap 48.

The sheet includes four sections for each of the two side panels 36, 38. Sections s10, s11 and s12 are the left side panel's outer layer 54, upper end 44, and inner layer 50, respectively. The inner layer is spaced from the outer layer by the upper end, and by a spacer bar 62, formed from section s13. Likewise, sections s14, s15 and s16 are the right side panel's outer layer, upper end 46, and inner layer, respectively. The inner layer is spaced from the outer layer by the upper end, and by a spacer bar, formed from section s17.

Figure 3A:
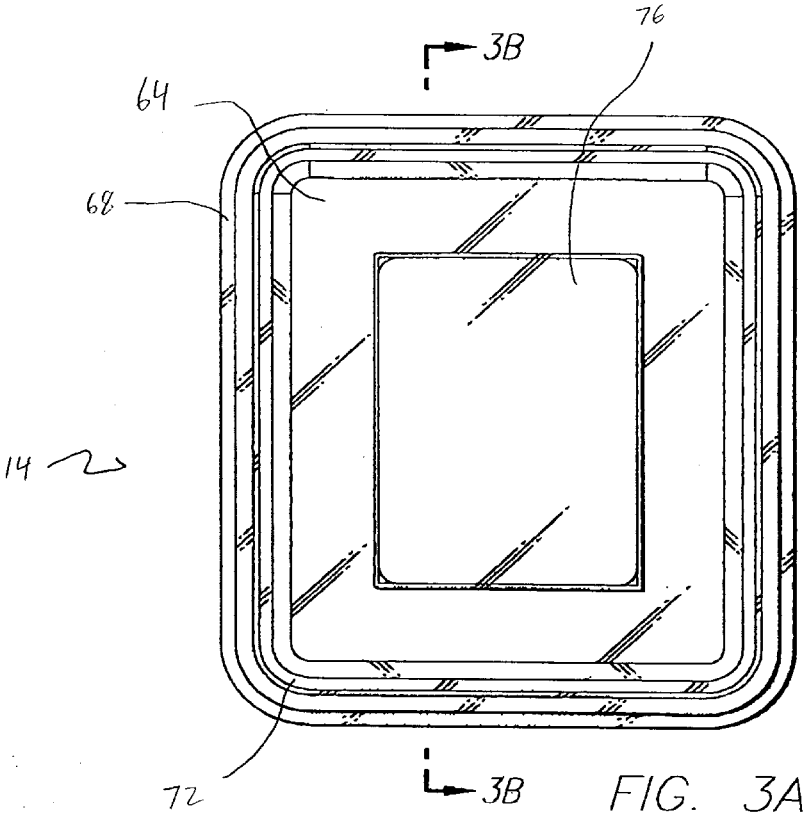
FIG. 3A is a front elevational view of a display pack included in the packaging assembly depicted in FIG. 1.
Figure 3B:
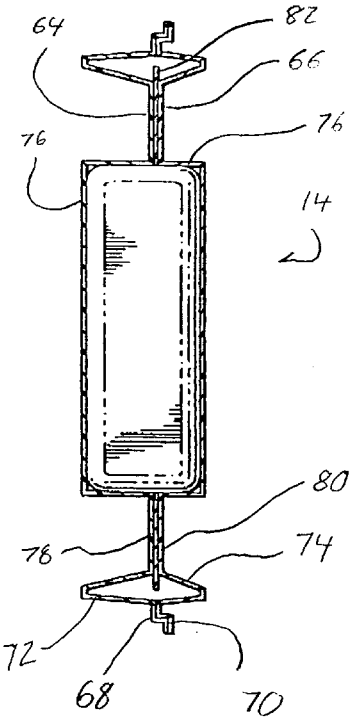
FIG. 3B is a cross-sectional, side elevational view of the display pack depicted in FIG. 3A, taken along line 3B—3B of FIG. 3A.

Each display pack 14, as depicted in FIGS. 3A and 3B, is an approximately planar assembly formed from a front portion 64 and a rear portion 66 of vacuum-molded plastic, or the like. The front and rear portions are each configured with a flange 68, 70, respectively, forming a notch that extends around the periphery of the respective portion. The front and rear portions' notched flanges conform to each other to allow the two portions to be adjoined (as seen in FIG. 3B), and further allow the notches to be heat sealed or glued together to form the display pack.

The front and rear portions 64, 66 are each further configured with a frame element 72, 74, respectively, protruding from the plane of the portions, around the periphery of the portions, but surrounded by the flanges 68, 70. The frames are configured such that the front and rear portions' frames protrude from the plane of the portion in opposite directions when the two portions are adjoined, as described above.

Additionally, the front and rear portions 64, 66 of the display pack 14 are configured with an indentation 76. The front and rear portions' indentations align to create a product chamber when the two portions are adjoined, as described above. The product chamber is configured to hold the packaged product 18, and is sized to conform to the packaged product, to accommodate both display and shipping requirements. A clear material is used to form the front and rear portions, providing for a product chamber that allows the packaged product it holds to be visible. The product chamber is located centrally within the flanges 68, 70 and the frames 72, 74 of the display pack, which is substantially larger than the packaged product, such that the product is more difficult to steal, and theft is thus deterred. Preferably, the front and rear portions each include flat panels 78, 80 extending between their frames and their indentations.

A flat product display card 82 is located between the front and rear portions 64, 66 of the display pack 14. Preferably the display card extends through the frames 72, 74 to the flanges 68, 70. The display card extends between the flat panels 78, 80, and forms a hole coinciding with the dimensions and location of the indentations 76, so as to accommodate a product 18 in the product chamber.

Each corresponding pair 58 of slots 52 is configured to receive any of the display packs 14, and each display pack is configured such that its flanges 68, 70 may be received in any corresponding pair of slots in the display stand 12, such that the display pack is supported by the display stand in a position to display the packaged product in the product chamber. Preferably each display pack is supported upright by the side panels, while the display packs adjoin the base panel 30, with their weight resting thereon.

A plurality of display packs 14 may be inserted into succeeding corresponding pairs 58 of the display stand's slots 52 to form a fully assembled display assembly. The slots hold the display packs substantially parallel to each other. The frames 72, 74 of the display packs are configured to adjoin with the frames of adjacent display packs (on either side) to provide structural support to each succeeding display pack. The product chambers of succeeding display packs are configured such that they do not structurally interfere with each other while inserted into the corresponding pairs of slots.

Figure 4:
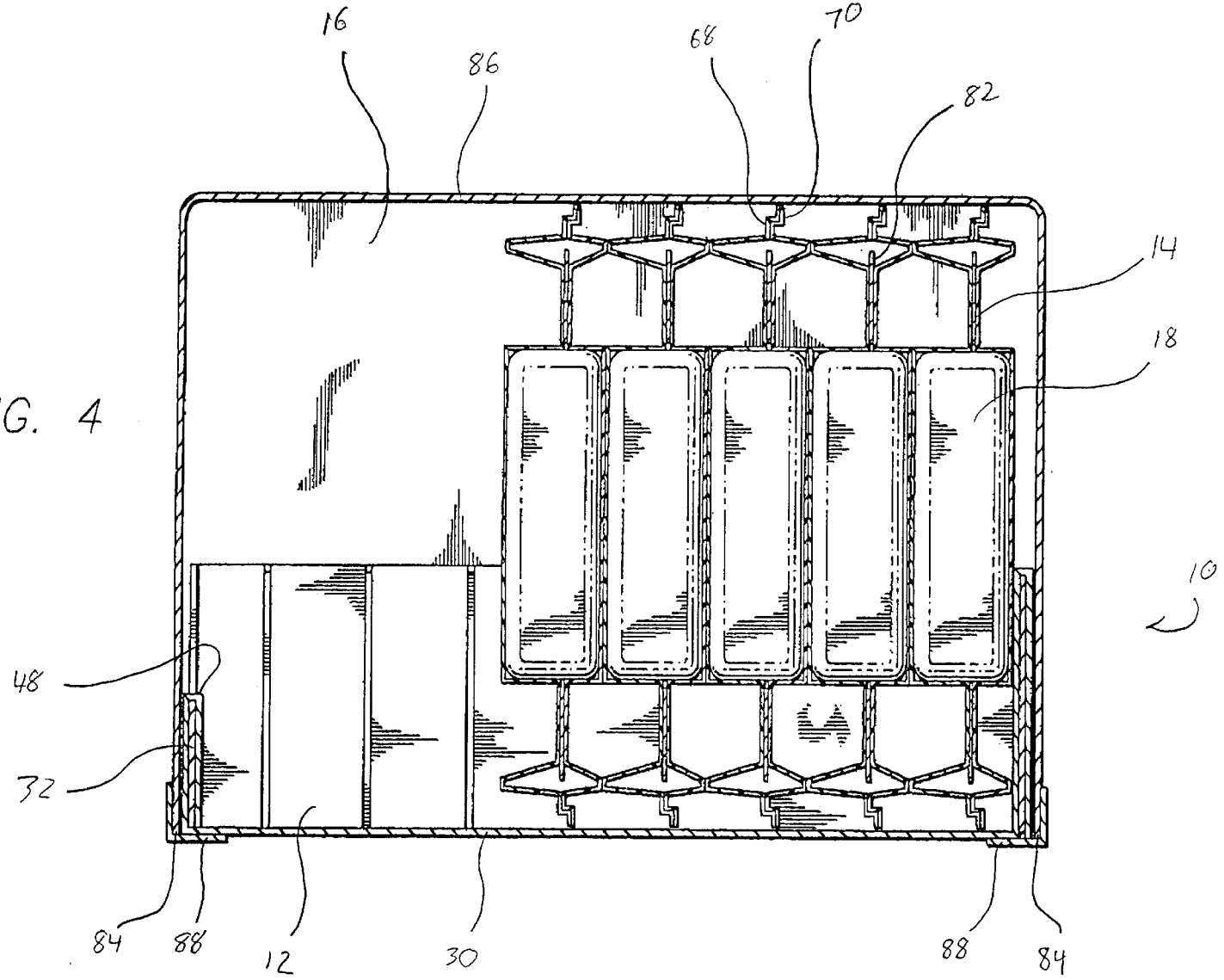
FIG. 4 is a cross-sectional, side elevational view of the packaging assembly depicted in FIG. 1 having three display packs removed.

As seen in FIG. 4, the display stand 12, with the plurality of display packs 14 inserted (three having been left out of the figure for clarity), may be covered with the shipping cover 16 to provide for shipping. The shipping cover is a conventional, five-sided, open-topped, rectangular box that has been inverted such that its rectangular opening 84 is on the bottom. This opening conforms to the shape and size of the base panel 30. The inside of the box defines a cavity configured to receive the assembled display assembly within the cavity such that the opening adjoins the periphery of the base panel.

An inner face of a top panel 86 of the shipping cover 16 adjoins the flanges 68, 70 of the display packs 14 when the shipping cover covers the display stand assembly and the shipping cover's opening 84 adjoins the base panel 30. In this configuration, the shipping cover may be taped, with any appropriate tape 88, along its opening, to the under side of the display stand's base panel to create a structurally sound packaging assembly in the form of a six-sided, rectangular box suitable for shipping.

In the packaging assembly 10, the packaged products 18 are suspended in the product chambers, significantly protecting them from damage during severe shipping accidents. The display packs 14 internally provide vertical and lateral support to the rest of the packaging assembly by partially carrying loads between the display stand 12 and the shipping cover 16.

After the fully assembled packaging assembly 10 is shipped, the tape may be cut with a knife around the opening 84 to allow the shipping cover 16 to be removed. After removal, the display stand assembly is ready for immediate product display. Normal shipping markings and minor shipping damage will only have affected the shipping cover and underside of the base panel 30 (which is not seen in normal use), and thus the appearance of the display assembly will not be degraded by the packaging and shipping.

On display, the gap 48 in the display stand's front panel 32 provides for improved viewing of the display packs 14. The display packs, while having an appealing shape, and preferably having a display card 82 to augment their appearance, display the packaged products 18 in full view, allowing the aesthetics of, and information on, the packaged products to encourage consumers to purchase the products.

Figure 5:
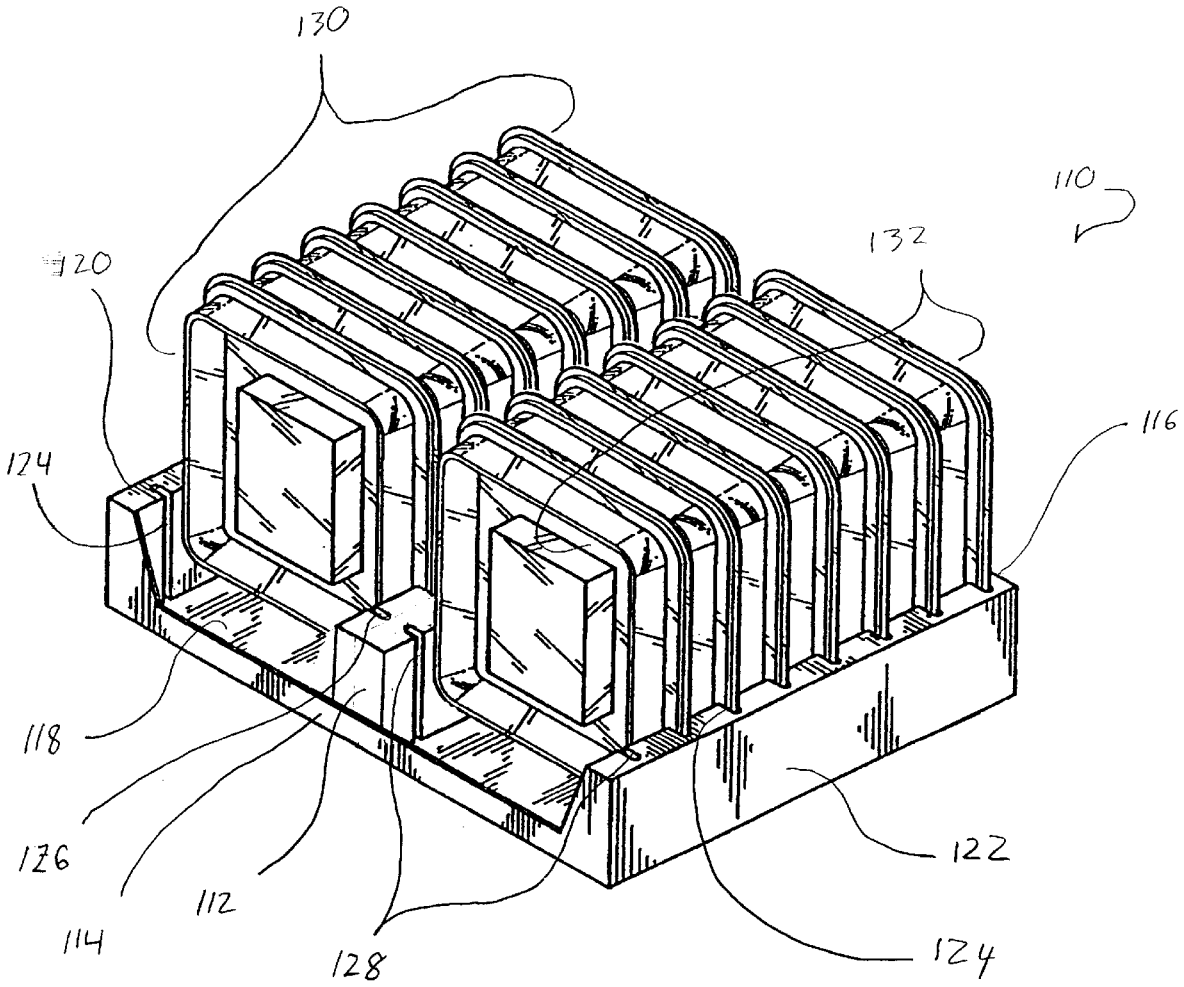
FIG. 5 is a perspective view of portions of a second embodiment of a packaging assembly embodying features of the present invention.

Portions of a second embodiment of a packaging assembly 110 according to the present invention is shown in FIG. 5. The embodiment generally includes the features depicted and described in the first embodiment, with the exception of the features described below.

The second embodiment includes an insert 112 extending from the front panel 114 to the rear panel 116, symmetrically located on the base panel 118. As in the first embodiment, each side panel 120, 122 defines a plurality of slots 124. However, each slot in the side panels has a corresponding slot 126 in the insert, thus forming corresponding pairs 128 of slots.

A first plurality of display packs 130, each being configured to hold one or more products, are configured to be inserted in the slots 124 of the left side panel 120 and their corresponding insert slots 126, thus forming one row of display packs in the packaging assembly 110. A second plurality of display packs 132, each being configured to hold one or more products, are configured to be inserted in the slots of the right side panel 122 and their corresponding insert slots, thus forming a second row of display packs in the packaging assembly.

While the insert 112 is preferably unitary, with symmetrically placed slots 126, it may be subdivided into sections, and have slots intermittently placed on alternate sides. Furthermore, there may be more than one insert running from the front panel 114 to the rear panel 116. A packaging assembly that includes two inserts running from the front panel to the rear panel could hold three rows of display packs, the third row being inserted in corresponding pairs of slots between the two inserts.

Either of the two embodiments above, with their shipping covers attached, are preferably sized such that a plurality of the packaging assemblies will fit evenly onto a standard sized shipping pallet (not shown) without having excess palate space left over. With the added package strength provided by the inventive packaging assembly, multiple layers of packaging assemblies may be stacked up and shrink wrapped for shipping.

Alternatively, the display assemblies may be shipped on pallets without their shipping covers. A first layer of display assemblies are placed on a pallet, and a first sheet of cardboard may be laid over the top of the first layer's display packs. A second layer of display assemblies are then laid on the sheet of cardboard. Further layers of cardboard and display assemblies may be added until a limiting weight or height is reached. The pallet and display assemblies are then surrounded by cardboard panels on four sides and the top, and wrapped in a suitable shrinkwrap material.

From the foregoing description, it will be appreciated that the present invention provides for economical bulk-shipping packaging, which includes good protection from product damage. It further provides for an economical setup of an appealing product display in a form that reduces the risk of product theft.

While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

I claim:

1. A packaging assembly for shipping and displaying a plurality of products, comprising:

a plurality of display packs, each display pack configured to hold at least one of the plurality of products, wherein each display pack is substantially larger than some of the products;

a display stand including a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form a corresponding pair of slots, wherein each corresponding pair of slots is configured to receive one of the display packs, and wherein the plurality of display packs are configured to be inserted in the corresponding pairs of slots to form an assembled display assembly; and a shipping cover, defining a cavity with an opening, the opening conforming to the periphery of the base panel, wherein the shipping cover is configured to receive the assembled display assembly within the cavity such that the opening adjoins the periphery of the base panel;

wherein the plurality of display packs are configured such that they extend up past the upper ends of the side panels when they are inserted in the corresponding pairs of slots to form an assembled display assembly;

wherein the display packs adjoin the base panel; and wherein the display packs adjoin an inner face of the shipping cover when the shipping cover receives the assembled display, wherein each display pack is configured with a frame protruding in opposite directions from the plane of the display pack, so as to provide structural support between the inner face of the shipping cover and the base panel.

2. The packaging assembly of claim 1, wherein the assembled display assembly, received within the shipping cover, forms a six sided rectangular box.

3. The packaging assembly of claim 1, wherein the display stand is constructed from a unitary sheet.

4. The packaging assembly of claim 1, wherein each side panel comprises an inner layer facing the other side panel and an outer layer facing away from the other side panel, the inner layer defining the plurality of slots, wherein each of the side panel layers are parallel to the other side panel layers.

5. The packaging assembly of claim 4, wherein the inner layer is spaced from the outer layer.

6. The packaging assembly of claim 1, and further comprising a substantially rectangular front panel that defines a gap for viewing the display packs.

7. The packaging assembly of claim 1, wherein each display pack comprises an approximately planar assembly formed from an approximately planar front portion adjoined to an approximately planar rear portion, each of which allows the products to be visible within the display pack.

8. The packaging assembly of claim 7, wherein the front and rear portions are each configured with a flange extending around the periphery of the portion, the flange configured to be received in any corresponding pair of slots.

9. The packaging assembly of claim 7, wherein the front and rear portions are each configured with a frame protruding from the plane of the portions, the frames protruding in opposite directions when the front and rear portions are adjoined, and wherein the frames of succeeding display packs in an assembled display assembly are configured to adjoin.

10. The packaging assembly of claim 7, wherein a product display card is located between the front and rear portions of the display pack.

11. The packaging assembly of claim 1, wherein the shipping cover is taped to the base panel.

12. The packaging assembly of claim 1, wherein each corresponding pair of slots is formed by one slot in the left side panel cooperating with one slot in the right side panel.

13. The packaging assembly of claim 12, wherein:

each display pack comprises an approximately planar assembly formed from an approximately planar front portion adjoined to an approximately planar rear portion, each of which allows the products to be visible within the display pack;

the front and rear portions are each configured with a frame protruding from the plane of the portions, the frames protruding in opposite directions when the front and rear portions are adjoined; and the frames of succeeding display packs in an assembled display assembly are configured to adjoin.

14. The packaging assembly of claim 1, wherein the display stand further includes at least one insert, wherein the at least one insert defines a plurality of insert slots, and wherein each corresponding pair of slots is formed by one slot in one of the side panels cooperating with one insert slot.

15. The packaging assembly of claim 14, wherein:

each display pack comprises an approximately planar assembly formed from an approximately planar front portion adjoined to an approximately planar rear portion, each of which allows the products to be visible within the display pack;

the front and rear portions are each configured with a frame protruding from the plane of the portions, the frames protruding in opposite directions when the front and rear portions are adjoined; and the frames of succeeding display packs in an assembled display assembly are configured to adjoin.

16. A method of packaging a plurality of products for shipping and display, comprising:

forming a plurality of display packs, each display pack holding at least one of the plurality of products, wherein each display pack is substantially larger than some of the products;

inserting the plurality of display packs in corresponding pairs of slots in a display stand to form an assembled display assembly, wherein the display stand includes a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form the corresponding pair of slots, and wherein each corresponding pair of slots is configured to receive one of the display packs;

covering the assembled display assembly with a shipping cover, wherein the shipping cover defines a cavity with an opening, the opening conforming to the periphery of the base panel, wherein the cavity is configured to receive the assembled display assembly within the cavity such that the opening adjoins the periphery of the base panel to cover the assembled display assembly; and applying tape between the base panel and the shipping cover to form a container suitable for shipping;

wherein, in the step of inserting, each corresponding pair of slots is formed by one slot in the left side panel cooperating with one slot in the right side panel;

wherein each display pack formed in the step of forming comprises an approximately planar assembly formed from an approximately planar front portion adjoined to an approximately planar rear portion, each of which allows the products to be visible within the display pack;

wherein the front and rear portions are each configured with a frame protruding from the plane of the portions, the frames protruding in opposite directions when the front and rear portions are adjoined; and wherein the frames of succeeding display packs in the assembled display assembly are configured to adjoin.

17. The method of claim 16, wherein the display packs formed in the step of forming are configured such that they extend up past the upper ends of the side panels when they are inserted in the corresponding pairs of slots to form an assembled display assembly.

18. The method of claim 17, further comprising the step of constructing the display stand from a unitary sheet prior to inserting the plurality of display packs.

19. The method of claim 17, wherein the step of forming the plurality of display packs includes adjoining a plurality of approximately planar front portions to a plurality of approximately planar rear portions, each of the portions allowing the products to be visible within the display pack.

20. The method of claim 19, wherein the front and rear portions are each configured with a flange extending around the periphery of the portion, and wherein the step of inserting the plurality of display packs in corresponding pairs of slots includes inserting the flanges into the corresponding pair of slots.

21. A packaging assembly for shipping and displaying a plurality of products, comprising:

a plurality of display packs, each display pack configured to hold at least one of the plurality of products, wherein each display pack is substantially larger than some of the products;

a display stand including a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form a corresponding pair of slots, wherein each corresponding pair of slots is configured to receive one of the display packs, and wherein the plurality of display packs are configured to be inserted in the corresponding pairs of slots to form an assembled display assembly; and a shipping cover, defining a cavity with an opening, the opening conforming to the periphery of the base panel, wherein the shipping cover is configured to receive the assembled display assembly within the cavity such that the opening adjoins the periphery of the base panel;

wherein the plurality of display packs are configured such that they extend up past the upper ends of the side panels when they are inserted in the corresponding pairs of slots to form an assembled display assembly;

wherein each display pack comprises an approximately planar assembly formed from an approximately planar front portion adjoined to an approximately planar rear portion, each of which allows the products to be visible within the display pack; and wherein the front and rear portions are each configured with a frame protruding from the plane of the portions, the frames protruding in opposite directions when the front and rear portions are adjoined, and wherein the frames of succeeding display packs in an assembled display assembly are configured to adjoin.

22. The packaging assembly of claim 21, wherein the display packs adjoin the base panel.

23. The packaging assembly of claim 21, wherein each side panel comprises an inner layer facing the other side panel and an outer layer facing away from the other side panel, the inner layer defining the plurality of slots, wherein each of the side panel layers are parallel to the other side panel layers.

24. The packaging assembly of claim 21, wherein the front and rear portions are each configured with a flange extending around the periphery of the portion, the flange configured to be received in any corresponding pair of slots.

25. The packaging assembly of claim 21, wherein the shipping cover is taped to the base panel.

26. The packaging assembly of claim 21, wherein each corresponding pair of slots is formed by one slot in the left side panel cooperating with one slot in the right side panel.

27. The packaging assembly of claim 21, wherein the display stand further includes at least one insert, wherein the at least one insert defines a plurality of insert slots, and wherein each corresponding pair of slots is formed by one slot in one of the side panels cooperating with one insert slot.

28. A packaging assembly for shipping and displaying a plurality of products, comprising:

a plurality of display packs, each display pack configured to hold at least one of the plurality of products, wherein each display pack is substantially larger than some of the products;

a display stand including a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form a corresponding pair of slots, wherein each corresponding pair of slots is configured to receive one of the display packs, and wherein the plurality of display packs are configured to be inserted in the corresponding pairs of slots to form an assembled display assembly; and a shipping cover, defining a cavity with an opening, the opening conforming to the periphery of the base panel, wherein the shipping cover is configured to receive the assembled display assembly within the cavity such that the opening adjoins the periphery of the base panel;

wherein each corresponding pair of slots is formed by one slot in the left side panel cooperating with one slot in the right side panel;

wherein each display pack comprises an approximately planar assembly formed from an approximately planar front portion adjoined to an approximately planar rear portion, each of which allows the products to be visible within the display pack;

wherein the front and rear portions are each configured with a frame protruding from the plane of the portions, the frames protruding in opposite directions when the front and rear portions are adjoined; and wherein the frames of succeeding display packs in an assembled display assembly are configured to adjoin.

29. The packaging assembly of claim 28, wherein the plurality of display packs are configured such that they extend up past the upper ends of the side panels when they are inserted in the corresponding pairs of slots to form an assembled display assembly.

30. The packaging assembly of claim 28, wherein the display packs adjoin the base panel.

31. The packaging assembly of claim 28, wherein the shipping cover is taped to the base panel.

32. A packaging assembly for shipping and displaying a plurality of products, comprising:

a plurality of display packs, each display pack configured to hold at least one of the plurality of products, wherein each display pack is substantially larger than some of the products;

a display stand including a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form a corresponding pair of slots, wherein each corresponding pair of slots is configured to receive one of the display packs, and wherein the plurality of display packs are configured to be inserted in the corresponding pairs of slots to form an assembled display assembly;

a shipping cover, defining a cavity with an opening, the opening conforming to the periphery of the base panel, wherein the shipping cover is configured to receive the assembled display assembly within the cavity such that the opening adjoins the periphery of the base panel; and at least one insert, wherein the at least one insert defines a plurality of insert slots, and wherein each corresponding pair of slots is formed by one slot in one of the side panels cooperating with one insert slot;

wherein each display pack comprises an approximately planar assembly formed from an approximately planar front portion adjoined to an approximately planar rear portion, each of which allows the products to be visible within the display pack;

wherein the front and rear portions are each configured with a frame protruding from the plane of the portions, the frames protruding in opposite directions when the front and rear portions are adjoined; and wherein the frames of succeeding display packs in an assembled display assembly are configured to adjoin.

33. The packaging assembly of claim 32, wherein the plurality of display packs are configured such that they extend up past the upper ends of the side panels when they are inserted in the corresponding pairs of slots to form an assembled display assembly.

34. The packaging assembly of claim 32, wherein the display packs adjoin the base panel.

35. The packaging assembly of claim 32, wherein the shipping cover is taped to the base panel.

36. A method of packaging a plurality of products for shipping and display, comprising:

forming a plurality of display packs, each display pack holding at least one of the plurality of products, wherein each display pack is substantially larger than some of the products;

inserting the plurality of display packs in corresponding pairs of slots in a display stand to form an assembled display assembly, wherein the display stand includes a base panel having a left edge and a right edge, a left side panel having a lower end and an upper end, the left side panel's lower end adjoining the base panel's left edge, and a right side panel having a lower end and an upper end, the right side panel's lower end adjoining the base panel's right edge, wherein each side panel defines a plurality of slots, each said slot cooperating with another slot defined by the display stand to form the corresponding pair of slots, and wherein each corresponding pair of slots is configured to receive one of the display packs;

covering the assembled display assembly with a shipping cover, wherein the shipping cover defines a cavity with an opening, the opening conforming to the periphery of the base panel, wherein the cavity is configured to receive the assembled display assembly within the cavity such that the opening adjoins the periphery of the base panel to cover the assembled display assembly; and applying tape between the base panel and the shipping cover to form a container suitable for shipping;

wherein, in the step of inserting, the display stand further includes at least one insert;

wherein the at least one insert defines a plurality of insert slots;

wherein each corresponding pair of slots is formed by one slot in one of the side panels cooperating with one insert slot;

wherein each display pack formed in the step of forming comprises an approximately planar assembly formed from an approximately planar front portion adjoined to an approximately planar rear portion, each of which allows the products to be visible within the display pack;

wherein the front and rear portions are each configured with a frame protruding from the plane of the portions, the frames protruding in opposite directions when the front and rear portions are adjoined; and wherein the frames of succeeding display packs in the assembled display assembly are configured to adjoin.

37. The method of claim 36, wherein the display packs formed in the step of forming are configured such that they extend up past the upper ends of the side panels when they are inserted in the corresponding pairs of slots to form an assembled display assembly.

38. The method of claim 36, wherein the step of forming the plurality of display packs includes adjoining a plurality of approximately planar front portions to a plurality of approximately planar rear portions, each of the portions allowing the products to be visible within the display pack.

39. The method of claim 38, wherein the front and rear portions are each configured with a flange extending around the periphery of the portion, and wherein the step of inserting the plurality of display packs in corresponding pairs of slots includes inserting the flanges into the corresponding pair of slots.

* * * * *